United States Patent [19]

David et al.

[11] Patent Number: 4,939,679

[45] Date of Patent: Jul. 3, 1990

[54] RECALIBRATING AN ELEVATOR LOAD MEASURING SYSTEM

[75] Inventors: George A. L. David, West Hartford; David H. Sorenson, South Windsor, both of Conn.

[73] Assignee: Otis Elevator Company, Farmington, Conn.

[21] Appl. No.: 230,384

[22] Filed: Aug. 9, 1988

[51] Int. Cl.[5] ..... B66B 1/24

[52] U.S. Cl. ..... 364/571.04; 187/115; 187/131; 364/550

[58] Field of Search ..... 187/115, 131; 364/550, 364/567, 571.01, 571.04

[56] References Cited

U.S. PATENT DOCUMENTS

| | | | |
|---|---|---|---|
| 3,486,101 | 12/1969 | Rufli | 187/115 X |
| 4,299,309 | 11/1981 | Bittar et al. | 187/131 |
| 4,305,479 | 12/1981 | Bittar et al. | 187/125 |
| 4,330,836 | 5/1982 | Donofrio et al. | 187/131 X |
| 4,501,343 | 2/1985 | Salihi | 187/119 |
| 4,553,640 | 11/1985 | Inaba et al. | 187/115 |
| 4,793,442 | 12/1988 | Heckler et al. | 187/115 |
| 4,828,075 | 5/1989 | Klingbeil et al. | 187/115 |

*Primary Examiner*—Parshotam S. Lall
*Assistant Examiner*—Edward R. Cosimano
*Attorney, Agent, or Firm*—Robert E. Greenstien

[57] ABSTRACT

Elevator load is computed from sensors. These sensors provide load signals. The load, defined by a stored load equation, is the product of those signals and a gain signal summed with an offset signal. Load computation using those signals is augmented by a recalibration routine. The routine to adjust the offset is initiated when the car transits floors in an empty car condition. Current equation offset and the latest empty car signal levels are compared. If the difference is less than a value the last levels become the offset; if not the equation offset is incremented changed. Load computation is further augmented by sensing car rollback, to augment the gain signal. Rollback may occur after the brake holding the car in position is lifted but before a speed dictation signal is given to the motor, causing the car to move if motor torque is not matched to the load as computed from the load equation. Depending on the magnitude of the rollback, the gain is increased or decreased in increments through successive elevator stops at floors provided there is sufficient passenger (cab) load. Rollback not caused by incorrect motor pretorquing when the brake is lifted is discarded by comparing the actual change in position of the car with the change in motor shaft or sheave position.

7 Claims, 2 Drawing Sheets

RECALIBRATING AN ELEVATOR LOAD MEASURING SYSTEM

TECHNICAL FIELD

This invention concerns elevators, in particular, recalibrating an elevator load measuring system.

BACKGROUND ART

U.S. Pat. No. 4,330,836 to Donofrio, et al, assigned to Otis Elevator Company, explores techniques for measuring passenger load in an elevator. The patent comments that elevator cab load measurement is prone to inaccuracies from a number of factors, for instance, friction in devices that measure cab displacement under load and changes in the flexibility of the connecting pads that are typically positioned between the cab and load sensors (e.g. force transducers). It also focuses on variations in load measuring accuracy produced by passenger location (i.e. load distribution) in the elevator cab. The patent discloses a technique for locating force transducers strategically below the cab floor. The transducers measure cab load in a way that has been found to provide improved load weighing accuracy. A load line equation defines the cab load as a function of the aggregate of the transducer output signals. Passenger load, i.e. cab load, is then computed in a signal processor from the product of the aggregate and a gain coefficient; the product is then summed with an offset. The gain represents the slope of the line equation, the offset the value of the aggregate, theoretically zero, when the cab is empty.

A manual adjustment or calibration procedure to set the correct offset and gain is also explained in that patent. Potentiometers are adjusted to scale the aggregate of the transducer output signals to the actual load in the cab, ideally canceling out mechanically produced errors causing incorrect cab load measurement.

Another patent, also assigned to Otis Elevator Company, U.S. Pat. No. 4,305,495 to Bittar, et al, explores controlling elevator the dispatching interval between cars to satisfy hall calls and car call demands. The patent explains, among other things, a way to use the cab load as determined in U.S. Pat. No. 4,330,936 in a computer-based dispatching system—an elevator in which a high-speed signal processor, such as a microprocessor, rapidly performs a wide variety of computations based on the condition of the elevator cars, cab load being one condition. The processor produces signals manifesting those conditions and the signals are then used by the processor to control dispatching of each car from a landing. In this manner, the elevator performance is regulated and controlled in a scheme that provides optimal overall system performance. Among uses made of cab load, is motor torquing to hold the elevator car in place after the motor brake is lifted in preparation for acceleration away from a landing.

In another patent assigned to Otis Elevator Company, U.S. Pat. No. 4,299,309 to Bittar et al, a system for "an empty elevator car determination" is discussed. Activity of passenger-actuatable switches in the elevator cab, such as a car call buttons, open door button, the emergency stop switch and the like, is monitored as an indication of presence of passengers in the elevator cab. A preliminary determination is made that the car is empty if such activity is absent. If the condition exists for a particular period of time, the car is conclusively determined "actually empty".

SUMMARY OF THE INVENTION

A main object of the present invention is to improve load weighing accuracy.

Among other objects of the present invention is providing a procedure for recalibrating a load weighing system in which the actual load is computed from a load line equation. For instance, as described in U.S. Pat. No. 4,330,836 to Donofrio as applied in the system disclosed in U.S. Pat. No. 4,305,479 to Bittar, et al.

According to the present invention, the magnitude of the line equation offset determined from signals manifesting cab load produced during a previous empty car condition is compared with the magnitude of the same signals produced during a subsequent empty car condition. The most current signals are made the line equation offset if the difference between the current offset and the current load signal are less than or equal to a reference value. If that difference is greater than the reference value, the offset from the last empty car condition is incremented up or down by a fixed increment towards the correct magnitude, which is reached after several subsequent empty car tests.

According to the invention, once the brake is lifted while a car is at a floor (landing), direction and magnitude of the car "rollback" is detected (up or down, depending on the magnitude of the load). An occurrence of rollback is sensed initially from motor rotation while the motor is "torqued" theoretically to a level sufficient to hold the car in place without aid of the brake. Rollback direction is determined from this initial rotation and is compared with the change in car position. If the directions are the same, change in car position is stored as the rollback magnitude. Position change is cyclically measured and compared with rollback direction in that manner until motor velocity is commanded by a "dictation" signal. Until that takes place, the largest rollback magnitude is stored through this process, as long as it corresponds in direction to the rollback direction sensed from the motor rotation. Those position changes that are not the result of incorrect motor torquing are thereby ignored.

According to the invention, the "gain", the coefficient for the load signal in the line equation that defines the load, is adjusted incrementally as a function of the magnitude and direction of the rollback.

According to the invention, the gain is increased by a small increment if the rollback magnitude is less than a constant; it is increased by a higher magnitude if it is greater or equal to that constant. If the magnitude of rollback is below a minimum value, gain is not increased at all.

According to the invention, gain recomputation is only carried out if the cab load reaches a certain load.

Among the features of the invention, gain and offset are adjusted incrementally, minimizing large changes caused by temporary system aberrations. The calibration process is an automatic part of the load computation routine used to provide a value for torquing the motor. Being automatic, the load weighing system is self-adjusting, always seeking the correct offset—by sensing the transducer outputs prior to an empty car determination—and always updating or adjusting gain until the rollback is within an acceptable range. Precise load computation is assured through an automatic procedure that takes place each time the car starts from a landing and each time an empty car condition is present.

BEST MODE FOR CARRYING OUT THE INVENTION

Figure 1:
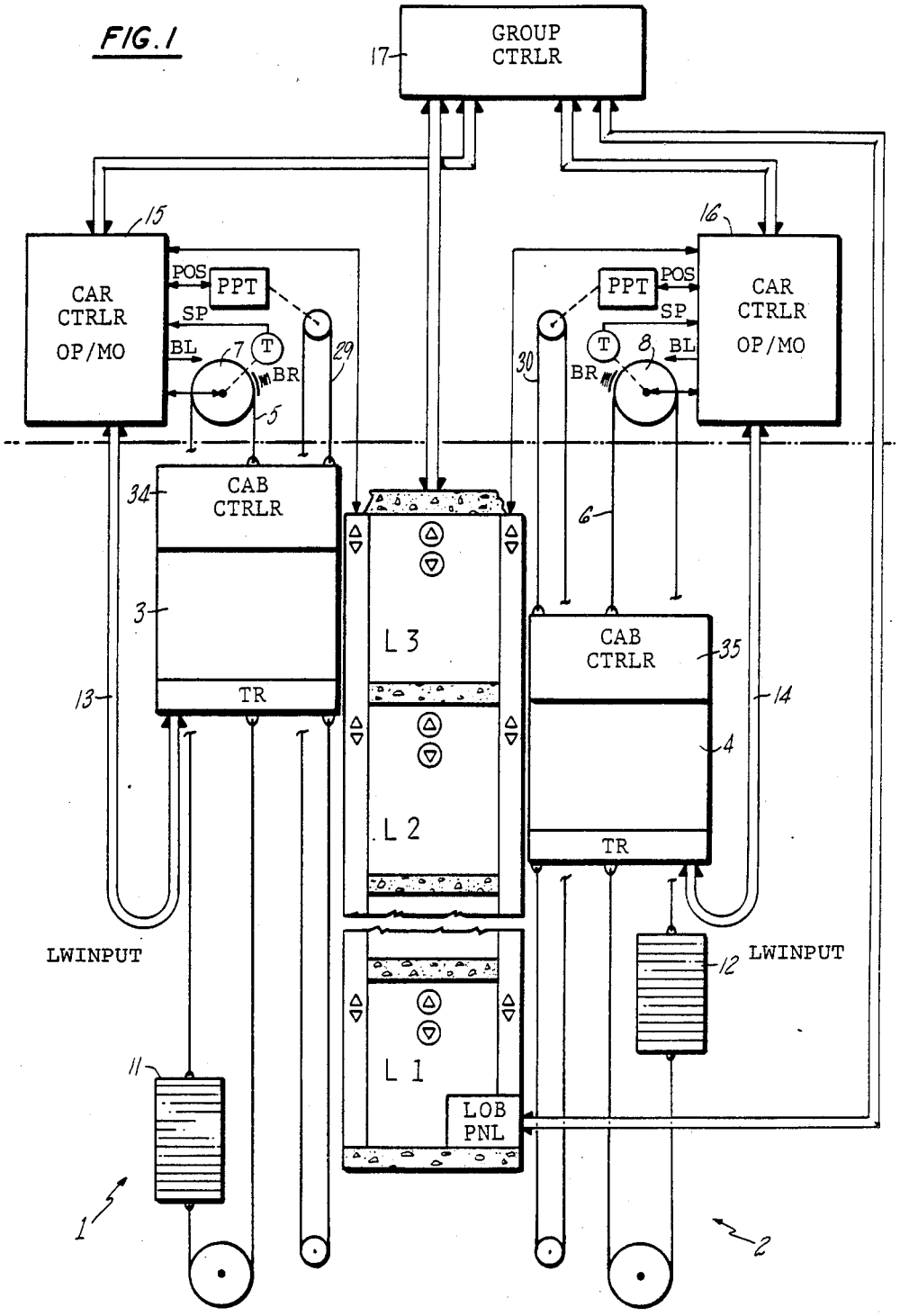
FIG. 1 is a functional block diagram of a duplex group elevator system; each car is controlled by a controller assumed to contain a signal processor, such as a microprocessor.

In FIG. 1, each of two elevator car systems 1, 2, defining a "group", contains an elevator car 3, 4, each serving a plurality of landings L1, L2, L3. Strictly in a functional sense, the system shown in FIG. 1 is very similar to the system shown in the Bittar, et al patents referred to earlier and is best viewed as an example of a typical "traction" elevator system with one or more signal processors (computers) to control elevator car motion and the combined service of the cars (the group) in the building. Being a traction elevator, each car has a counterweight 11, 12, which is connected via a cable or rope 5, 6 to the elevator car. The cable passes around a sheave 7, 8, rotated by an electric motor, which is not shown in FIG. 1. Each car 3, 4 is assigned a cab controller 34, 35 and a positive position transducer (PPT). A traveling cable 13, 14 provides an electrical signal path between for bidirectional communication between a car controller and a car operation and motion controller 15, 16. Among those signals is LWINPUT, a signal manifesting the cab or passenger load. LWINPUT is produced in response to load signals from load sensors, e.g. force transducers (TR) below the floor of the cab on each car. The car controllers communicate with a "group controller" 17. The group controller coordinates the operation of the cars through each car controller to achieve a level of group elevator service to the landings by the cars in response to calls at the level L1 made on the lobby operating panel (LOB PNL). An expansive discussion of group control is presented in the Bittar, et al patents previously identified.

Each car is connected to the PPT by a metal tape or cable 29, 30. A tachometer T is rotated by the sheave providing a SP signal that reflects or manifests sheave velocity (speed and direction). The PPT provides a POS signal that manifests the position of the car in the hoist way (elevator shaft). A car controller and the group controller stores the instantaneous POS signal for the car, using it as information on the location of the car when establishing priorities in assigning cars to hall calls. Similarly, the SP signal is continuously monitored and stored. The calibration routine of the present invention uses that information, which is continuously obtained from the PPT and the tachometer T.

A brake BR engages the sheave when car is stationary—at a floor. The brake is operated (lifted from the sheave) by a brake lift (BL) signal from the car controller. When a car moves from the floor, the brake is lifted, simultaneously the motor is torqued—power is applied to the motor to hold the car in place without the brake. Then more power is provided in response to a speed dictation signal generated by the car controller, causing the car to accelerate. There is a short interval of time between brake lift and acceleration, in which interval part of the recalibration processes presently explained takes place using the car motion that takes place if the torquing is too high or low.

For the purposes of this discussion, it should be assumed that motor torquing after the brake is "lifted" is proportional to the computed load determined from this equation (1):

$$LW\ CORRECTED = LWGAIN \times LWINPUT - LW\text{-}OFFSET \quad (1)$$

LWCORRECTED is the "corrected passenger load", the load using the line equation recalibrated or "corrected" according to the invention. LWINPUT is the sum of the transducer TR signals for the car. LWOFFSET is the value or magnitude of LWINPUT when the cab is empty (no passengers). (For additional discussion of this equation and the use of force transducers, see U.S. Pat. No. 4,330,836, cited previously.)

The balance of this discussion explores the way in which LWGAIN and LWOFFSET in equation 1 are adjusted (increased and decreased) using the sequences explained below and illustrated in the flow chart comprising FIG. 2. The discussion assumes that each car controller carries out the sequences through a resident program accessed by a command to begin recalibration. It also assumes that an empty car determination has been made according to the techniques of the U.S Pat. No. 4,299,309 leading to the production of "empty car flag". The term "rollback" defines a possible change in car position of a car when the brake is lifted and the motor is torqued—based on LWCORRECTED. If the torque is too low, because the corrected passenger load is low, the rollback will be one direction. If the corrected passenger load is too high, rollback will be in the opposite direction. Rollback direction is sensed from the SP signal from the tachometer T. Rollback magnitude (on the other hand) is determined by the change in position in the POS signal Oscillations at the car (but not the sheave) from cable elasticity car cause small bidirecticnal position changes until the car "settles down" before speed dictation (acceleration commences). The calibration routine compares sheave motion with position change. This ignores position changes that are in the wrong direction—not representative of true rollback. Rollback sensing, which is done to find the maximum roll-back, takes place cyclically (repetitively) until speed dictation occurs. From the stored maximum rollback, LWGAIN is adjusted higher or lower—so that on the next calibration sequence (when the car again starts) the rollback will be less. The routine, it will be shown, takes place each time the car starts with a passenger load exceeding a preset level and continues until speed dictation begins. For the purpose of this discussion, the assumption is that a low passenger load computation will occasion low torquing, causing the car to move down when the brake is lifted. LWOFFSET also impacts torquing; for that reason, actual LWGAIN modification or adjustment takes place only if LWOFFSET is within an acceptable range. Otherwise, rollback is sensed and stored but not used to adjust LWGAIN.

Figure 2:
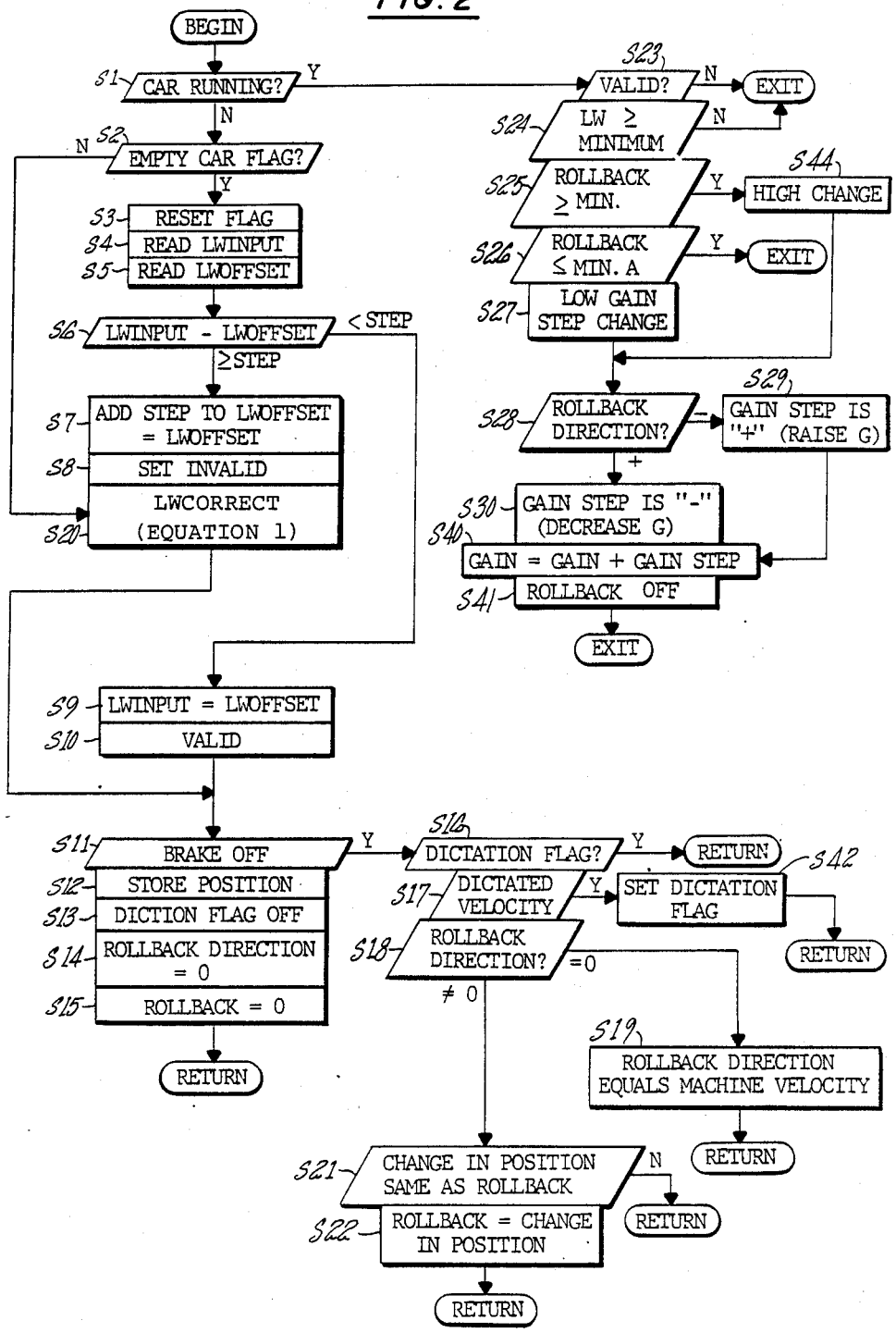
FIG. 2 is a flow chart showing a signal processing sequence or subroutine for load measurement and computation recalibration according to the present invention.

Referring to FIG. 2, the LWGAIN and LWOFFSET recalibration routine begins by moving to a first test S1 which determines whether the car speed dictation signal has been applied to the motor; that is, the car is "running" (moving or about to move)? The speed dictation signal is produced following a short interval after the brake is lifted by the BL signal, at which point in time the motor is given a pretorquing signal, ideally sufficient to cause the car to remain in place after the brake is lifted. It should be noticed that the recalibration routine will also sense as a running condition a releveling signal to the motor. A releveling signal is produced by the car controller to cause the car to level if it drops outside the "level zone", usually a band of 0.25 inches above and below floor level. For instant purposes, it is assumed that the car is not running, producing a negative answer at test S1. The recalibration technique then moves to step S2, which queries whether the "empty car flag" has been set from an empty car determination routine (preferably by following the routines set out in U.S. Pat. No. 4,299,309). Assuming that an empty car flag is set, that leads to an adjustment of LWOFFSET. This discussion also assumes that when the empty car condition was sensed that the signals, LWINPUT, from the transducers were also stored, and, if any empty car condition is not detected at step S2, the correct load is determined at step S20 using the stored values of LWGAIN, LWINOUT and LWOFFSET from the previous operation cycle the calibration program. At step S3, the empty car flag is reset. In step S4 the transducer outputs are read as the "LWINPUT". From storage (computer memory), the current offset "LWOFFSET" is read at step S5. This is a latest value for LWOFFSET, as determined by the same routine—but following an earlier empty car determination. The object of the sequence is to determine whether that latest (current) LWOFFSET is correct. Thus, in step S6, a test is made to determine whether the difference between LWINPUT and LWOFFSET as read in step S5 is less than or equal to a constant "STEP" (an error). Assuming that the difference is greater than or equal to STEP, step S7 adds STEP to the LWOFFSET (not the most current value, but the "next to latest" value), which now becomes LWOFFSET in equation 1. It should be observed that the result of this particular routine is that only STEP has been added to LWOFFSET. Consequently, when that takes place, LWOFFSET does not exactly indicate the empty load value for zero load, although the difference is now reduced. In step S8, an "invalid" flag is set and the routine continues at step S20. The "invalid" flag is used later to show that the line equation has not been recalibrated to the point that the difference between the zero load condition and the load associated with the stored LWOFFSET is sufficiently small that LWGAIN can be adjusted accurately. (An LWOFFSET adjustment should not compensate for inaccurate LWGAIN and visa-versa.)

Going back to step S6, if the difference between the LWINPUT and LWOFFSET is less than STEP, at step S9 LWOFFSET is made the same as LWINPUT, meaning that now there is no difference between the no-load condition and the zero load value for LWOFFSET. A "valid" flag is set at step S10 and the routine continues at step S11. The "valid" flag, when present, allows the LWGAIN adjustment to take place in a later part of the routine because the line equation is devoid of any errors in LWOFFSET at the time the measurements of rollback are made.

LWOFFSET is thus adjusted in the previous sequences either to the current level of the transducer outputs (LWINPUT) or to some new level which was the previous LWOFFSET plus (or minus) STEP but less than LWINPUT.

In step S11, a test is made to determine whether the brake is OFF, meaning that the brake has been lifted and the car is about to accelerate from the floor or landing. If the brake is still ON, (BL signal is not present) steps S12–S15 initialize parameters used in the subsequent LWGAIN adjustment sequences. In step S12, the current position of the car, the POS signal, is stored. The speed dictation flag is set to OFF in step S13. In step S14, the rollback direction is set to zero. And, in step S15, the rollback magnitude is set to zero.

Following step S15, the routine returns (repeats from "start"). It continues the cycle until the test at S11 is positive—because the brake is lifted. Step S16 asks whether there is a dictation flag. Where, if the dictation flag is set the routine returns to step S1. A dictation flag is raised in a previous cycle when a speed dictation signal (to accelerate or relevel the car) is produced by the controller. At the time the brake is lifted, the motor is given a signal to torque it (to hold) the car in place. The signal is proportional to LWCORRECTED, a load computed using adjustments made to LWGAIN and LWOFFSET using this calibration routine, but at a prior floor stop. (A speed dictation command, "DICTATION", on the other hand, causes the car to accelerate.

Once the brake is lifted, the routine cyclically tests the rollback while the motor is torqued but not commanded to accelerate (no dictation) at step S17. An affirmative answer at step S17 causes the routine to return, after setting the dictation flag at step S42, beginning at step S1, where, once again, the test shows that the car is still not running. (A positive answer, it will be shown, causes the routine to move to a gain adjustment sequence, where the rollback direction and magnitude are used to increase or decrease the LWGAIN in incremental steps depending on rollback magnitude.

For the moment, however, this discussion assumes that a dictation flag signal has not been raised and thus the sequence moves from step S16 through step S17 to step S18. At this point a test is made to determine whether the rollback direction is equal to zero. If it is equal to zero at step S18, the routine is then recycled through RETURN, because the rollback direction (set at zero in step S15) and the actual rollback (based on position information from the PPT) are zero, causing the routine to return to the beginning after the rollback direction is made equal to the machine velocity in step S19. This is done by retrieving the output SP, from the tachometer. The tachometer T, of course, will provide an indication of the small motion of the rotation of the motor sheave 7, 8. At step S19, the rollback direction is made non-zero if machine velocity is non-zero, indicating that the car has moved, then step S18 moves the routine to step S21, where the greatest rollback magnitude is stored. In this way rollback is cyclically sensed following brake lifting until speed dictation happens. This routine of sampling position change occurs very rapidly throughout the interval before speed dictation and following the lifting of the brake. Following brake lift, the car will start to move either up or down slightly, perhaps even with a oscillatory motion. It is an object of the sequence to sense the greatest rollback magnitude yet at the same time ignore the changes in rollback that are associated with oscillatory movement. These are changes in car position that are not associated with inadequate motor torquing to hold the car in place without the brake. Long time constants in an elevator cause unphased movements of the car and sheave. At some point in time, not necessarily before speed dictation, the car and sheave stop moving.

Consequently, in step S21, a coincidence test in effect, a test is made to determine whether rollback, the change in position sensed by the tachometer is in the same direction as the actual change in position shown any change in the POS signal provided by the PPT. If the directions are not the same, step S21 causes the routine to recycle, as a result rollback, initialized at zero in step S15, is left unchanged. If, however, step S21 yields a positive answer (the directions are the same), at step S22, rollback is made to equal the change in position (measured from the change in the POS signal). Thus, the rollback signal is no longer to equal zero and the routine again cycles through the beginning to examine rollback at a second point in time, when it will store the next sensed change in position as the rollback—if it is greater than the previously stored value and in the same direction as the change in sheave position.

Eventually, the routine finds a positive answer to the running test at S1. The routine would then move to step S23, leaving the portion in which rollback is cyclically sensed and the maximum change in rollback position is stored and allowing the routine to move into the steps to actually change LWGAIN based on the magnitude and direction of the stored rollback.

For the moment, however, the discussion assumes that S1 still yields a negative answer. Since the empty car flag has been set to zero during the previous adjustment of LWOFFSET, causes the routine at step S2 to provide a negative answer, causing the routine to move step S20 and the routine continues at step S11. Here, the load LW CORRECTED is computed from the line equation 1. The computation uses the new or updated LWOFFSET, but the currently stored LWGAIN. LWGAIN is adjusted after the car begins to move from the floor, which has not happened at this point in the discussion.

Following a positive answer at step S1, at S23, the test determines if is a valid flag. The valid flag is set at step S10 if the condition is satisfied that LWINPUT is within STEP of LWOFFSET. An adjustment of the gain based upon the rollback should not be made unless it is first determined that the offset of the system is within some acceptable limits. For instance, if it is determined in step S6 that the difference between LWINPUT and LWOFFSET is greater than or equal to STEP the offset is only partially eliminated. Consequently, a LWGAIN adjustment should not be made (steps S23–S41) because LWGAIN will be adjusted because of an error in offset, not the line slope (LWGAIN) in equation 1.

At step S23 if the valid flag is set as invalid (step S8), then the routine is exited. For the moment, this discussion assumes that the "valid" flag has been set; thus step S23 yields a positive answer, moving the routine to step S24. This test finds, using the load computed at step S20, that the current corrected load weight (using the unadjusted current LWGAIN and LWOFFSET values) exceeds a minimum level. If the passenger load is not high enough the routine ignores the rollback data collected, assuming, in effect, that the results are not reliable at low load levels and exits through step S24. Passenger load greater than or equal to 60% of full load is the preferred minimum, a condition occurring typically during the up-peak period, e.g. the morning in an office building.

Step S25 is entered following an affirmative answer to step S24. Step S25 determines that the rollback is greater than or equal to a value (MIN.). If it is, a high incremental change in the gain is commanded in step S44. If it is not, a test is made in step S26 to determine whether the rollback exceeds a minimum level (MIN.A). If not, the routine is exited. The assumption is that no adjustment is needed if the rollback is small. If rollback, is greater than MIN.A but less than MIN. it is in a range commanding a "low" incremental at step S27 change. Both steps S27 and S44 lead to testing, at step S28, to find if the rollback increment, be it high or low, must be added to or subtracted from the current LWGAIN. If pretorquing is inadequate, as indicated by the rollback direction at S14, LWGAIN will have to be increased through step S29. If pretorquing is excessive, causing rollback in the opposite direction, LWGAIN will have to be decreased at step S30. As a practical matter, if LWGAIN is low the rollback will be towards a lower floor (down) if the adjustment is done with at least 60% of full load.

In step S40, LWGAIN is set to equal current LWGAIN plus the gain step (it may be plus or minus from steps S29 and S30 and either the high level or low level). Then in step S41, the rollback flag, set at step S15, is set back to zero (turned off) and the routine is then exited, LWGAIN having been adjusted for the next load computation, when the rollback test will again be conducted.

It can be seen from the foregoing that in this manner passenger load (cab load) is computed using the most recently determined LWOFFSET and LWGAIN (the most current load line equation). Absent the rollback flag, the routine can not be entered until the rollback flag is again set when the brake is lifted, which takes place at the next stop at a landing.

Although, the best mode for carrying out the invention has been discussed, other modes are possible. One skilled in the art will find it possible to make modifications in whole or in part to this embodiment without departing from its true scope and spirit, for instance modifying the exemplary routines and components to which the explanation of the invention has referred. Likewise, empty car determination does not have to be discerned using the same techniques. Nor must load weighing employ force transducers to compute the load form a line equation. Likewise, computations of cab load and the other parameters in the cab load equation can be evolved, updated and used with the invention with hard wired signal processors (although microprocessor controls and related peripherals are preferred) and different sensors for rollback and car position. The invention can be used in systems with only one controller. Other modifications to, and derivations of, the invention are possible.

We claim:

1. A method for load weighing in an elevator wherein a signal (LWINPUT) produced from a load in an elevator cab is multiplied by a stored coefficient (LWGAIN) and summed with a stored value (LWOFFSET) to provide a cab load signal used to control the torque of a motor connected to the cab, said method being characterized by an automatic calibration routine comprising the steps:

producing a first signal which indicates a stored first value for LWOFFSET at a first determination of an empty cab condition;

producing LWINPUT at a subsequent determination of an empty car condition;

storing a second value which indicates the magnitude of LWINPUT as LWOFFSET if the difference between said first value and LWINPUT is less than or equal to a stored third value; and if said difference is greater than said third value, summing a stored fourth value with said first value to produce a fifth value and storing said fifth value as said LWOFFSET.

2. A method for load weighing in an elevator wherein a signal (LWINPUT) produced by a load in an elevator cab is multiplied by a stored signal manifesting a coefficient (LWGAIN) and summed with a stored signal manifesting a value(LWLWOFFSET) to provide a cab load signal that is used to control the torque of a motor, connected to a car containing the cab, after a brake, connected to the car, is lifted, the elevator having means for providing a position signal which indicates a change in car position and means for producing a machine velocity signal which indicates a change in motor position, said method being characterized by an automatic calibration routine comprising the steps:

(a) providing a rollback signal in response to a change in motor position as indicated by the machine velocity signal after said brake is lifted, said rollback signal indicating the direction of motor motion;

(b) storing a rollback position signal that which indicates the change in car position after the brake is lifted, said rollback position signal being stored if said change in position and the machine velocity indicating the same car velocity direction said rollback position signal being produced from a detected change in the position of the car;

(c) repeating steps (a) and (b) until a motor velocity signal is provided:

(d) modifying LWGAIN in relation to the magnitude of said rollback position signal to change motor torque whereby said change in position following the next lifting of said brake for said load is reduced.

3. A method according to claim 2, characterized by the additional steps:

(e) storing a first signal which indicates a first value for LWOFFSET at a first determination of an empty cab condition;

(f) producing LWINPUT at a second subsequent determination of an empty car condition;

(g) storing said second value as LWOFFSET if the difference between the first value and LWINPUT is less than or equal to a stored third value; and (h) if said difference is greater than said third value, summing a stored value with said first value to produce a fifth value and storing said fifth value as LWOFFSET.

4. A method according to claim 2 or 3, characterized in that LWGAIN is modified by a first number if said change in car position is less than or equal to a first stored value and greater than a second stored gain level and is modified by a second increment larger than said first number if said change in car position is greater than said first stored gain level.

5. An elevator comprising a car, a motor, a motor controller for controlling the torque of the motor and making an empty car determination, a brake lifted by a signal from the controller when the car departs a landing, a position transducer connected to the car for providing a position signal which indicates car location, a transducer connected to the motor for providing a motor velocity signal, load sensing means for providing a first load signal (LWINPUT) which indicates the magnitude of load in a car connected to the car and signal processing means for receiving the first load signal and computing therefrom a second signal which indicates the cab load according to a formula wherein cab load equals the product of a stored gain signal (LWGAIN) and the first load signal summed with a load offset signal (LWOFFSET), said elevator being characterized by said signal processing means comprising:

means for providing a stored first value for LWOFFSET made at a first determination of an empty cab condition;

means for storing the value of LWINPUT as the stored value of LWOFFSET if the difference between the first value LWOFFSET and LWINPUT at subsequent determination of an empty car condition is less than or equal to a stored third value; and means for summing, if said difference is greater than said third value, a fourth signal with said first value of LWOFFSET.

6. An elevator comprising a car, a motor, a motor controller for controlling the torque of the motor, and providing a motor dictation signal, a brake lifted by a signal from the controller when the car departs a landing, a position transducer connected to the car for providing a position signal which indicates car location and a transducer connected to the motor for providing a motor velocity signal, load sensing means for providing a first load signal (LWINPUT) which indicates the magnitude of load in a car connected to the car and signal processing means for receiving the first load signal and computing therefrom a second signal which indicates the cab load according to a formula wherein the cab load equals the product of a stored gain signal (LWGAIN) and the load signal summed with a load offset signal (LWOFFSET) representing the empty cab load, said elevator being characterized by said signal processing means comprising:

means for providing a first signal that which indicates a change in motor position after the brake is lifted;

means for successively providing a second signal that which indicates the magnitude of said change in car position after the brake is lifted at a first floor stop until the motor dictation signal is provided;

means for storing said second signal if the direction of motor position change and the direction of the change in car position is the same and said second signal is greater than a stored value representing the magnitude of said second signal as previously provided since the brake was lifted;

means for modifying a stored magnitude LWGAIN in relation to the magnitude of said stored second signal at the time said motor dictation signal is provided to adjust the magnitude of LWINPUT so that subsequent motor torque when the brake at a subsequent floor stop lifted will cause the magnitude of said stored second signal, for the same load signal, to be smaller.

7. An elevator according to claim 6, characterized by:

said means for providing LWGAIN comprising means for adjusting said magnitude of LWGAIN by a first incremental valve if said stored second signal is less than or equal to a first stored value and greater than a second stored minimum value and for adjusting said LWGAIN magnitude by a second increment, greater than said first increment, when said stored second signal is greater than said first stored value.

* * * * *

UNITED STATES PATENT AND TRADEMARK OFFICE

CERTIFICATE OF CORRECTION

PATENT NO. : 4,939,679

DATED : July 3, 1990

INVENTOR(S) : George A. L. David; David H. Sorenson

It is certified that error appears in the above-identified patent and that said Letters Patent is hereby corrected as shown below:

Col. 1, line 42, "elevator the" should read --the elevator--.
Col. 1, line 45, "4,330,936" should read --4,330,836--.

Col. 2, line 10, "equation. For" should read --equation, for--.
Col. 2, line 12, "4,305,479" should read --4,305,495--.

Col. 3, line 32, "between for" should read --for--.
Col. 3, line 51, "hoist way" should read --hoistway--.
Col. 3, line 59, "when car" should read --when the car--.
Col. 4, "LW" on line 9 and "CORRECTED" on line 10 should be combined to read --LWCORRECTED--.
Col. 4, line 40, "signal Oscillations" should read --signal. Oscillations--
Col. 4, line 41, "car" should read --can--.
Col. 4, line 42, "bidirecticnal" should read --bidirectional--.
Col. 4, line 48, "roll-back" should read --rollback--.
Col. 4, line 67, "that is, the" should read --that is, is the--.
Col. 4, line 68, "is "running"" should read --"running"--.
Col. 5, line 23, "LWINOUT" should read --"LWINPUT"--.
Col. 5, line 24, "cycle the" should read --cycle of the--.
Col. 6, line 19, "(to hold) the car in place." should read --to hold the car in place).--.
Col. 6, lines 24, 25, "accelerate." should read --accelerate.)--.
Col. 6, line 36, "magnitude." should read --magnitude.)--.
Col. 6, line 61, "with a" should read --with an--.
Col. 7, line 14, "to equal" should read --equal to--.
Col. 7, line 41, "if is" should read --if there is--.
Col. 7, line 58, "load computed" should read --load weight (LW) computed--.
Col. 8, lines 10, 11, "at step S27 change." should read --change at step S27.--.
Col. 8, line 47, "form" should read --from--.

UNITED STATES PATENT AND TRADEMARK OFFICE

CERTIFICATE OF CORRECTION

PATENT NO. : 4,939,679

DATED : July 3, 1990

INVENTOR(S) : George A. L. David; David H. Sorenson

It is certified that error appears in the above-identified patent and that said Letters Patent is hereby corrected as shown below:

Claim 2, Col. 9, line 14, "(LWLWOFFSET)" should read --(LWOFFSET)--.
Claim 2, Col. 9, line 27, "that which" should read --which--.
Claim 6, Col. 10, line 39, "that which" should read --which--.
Claim 7, Col. 10, line 61, "valve" should read --value--.

Signed and Sealed this

Twenty-eighth Day of April, 1992

*Attest:*

HARRY F. MANBECK, JR.

*Attesting Officer*

*Commissioner of Patents and Trademarks*